United States Patent [19]

Bell, Jr. et al.

[11] 4,230,344

[45] Oct. 28, 1980

[54] BUSINESS FORM WITH ELECTRICALLY CONDUCTIVE LAYER

[75] Inventors: Vincent G. Bell, Jr., Berwyn; Thomas P. Burke, Harleysville, both of Pa.; George D. Margolin, Newport Beach; Victor V. Vurpillat, Laguna Niguel, both of Calif.

[73] Assignee: Centurion Data Corporation, King of Prussia, Pa.

[21] Appl. No.: 879,113

[22] Filed: Feb. 21, 1978

[51] Int. Cl.[3] ..... B42D 15/00

[52] U.S. Cl. ..... 283/6; 283/9 R

[58] Field of Search ..... 283/6–9 R, 283/58, 57–59; 40/2.2; 235/488; 428/916, 204, 209, 211

[56] References Cited

U.S. PATENT DOCUMENTS

| | | | |
|---|---|---|---|
| 1,671,418 | 5/1928 | Frankel | 283/8 R |
| 2,536,371 | 1/1951 | Hutchison | 282/23 |
| 3,075,791 | 1/1963 | Wolf | 282/1 |
| 3,405,256 | 10/1968 | Weber | 235/488 |
| 3,672,703 | 6/1972 | Jay | 282/25 |
| 3,831,119 | 8/1974 | Ambrosio | 235/488 |
| 3,902,262 | 9/1975 | Colegrove et al. | 40/2.2 |
| 3,986,001 | 10/1976 | Saito | 235/61.11 E |

*Primary Examiner*—John McQuade
*Attorney, Agent, or Firm*—David S. Woronoff

[57] ABSTRACT

A business form has first and second coatings one of which is electrically conductive and the other is electrically non-conductive. The coatings are of contrasting colors and the second coating is electrically vaporizable for exposing the underlying coating when selectively removed during a "write" operation. The coatings may overlay a base material to form a three layer structure or the base material itself may function as one of the coatings of appropriate color and conductivity. A third coating overlays the second coating to form a matrix or array thereby organizing the document into sections. At the same time the third coating is put down, a light coat of a contrasting color can be overlaid the second coating. These two operations can be performed separately and in either order. The business form may be composed of first and second sections in which the second section may be a repeat of the basic information contained in the first section. The second section itself may be repeated either in total or in part in more than one place on the business form. One or more of these parts may be easily detached. The second section is encoded for machine reading. One or both sections may have marks to indicate the position of the section with respect to a input-output device.

31 Claims, 3 Drawing Figures

BUSINESS FORM WITH ELECTRICALLY CONDUCTIVE LAYER

CROSS REFERENCE TO RELATED APPLICATIONS

The present application is related to three other patent applications filed on the same date as the present application and assigned to a common assignee. Those applications are "Check", Ser. No. 879,114 invented by Thomas P. Burke, Vincent G. Bell, Victor Vurpillat and George Margolin; "Computer Input-Output Device", Ser. No. 879,116, invented by Victor Vurpillat and George Margolin; and "Computer System", Ser. No. 879,115 invented by Victor Vurpillat and George Margolin.

BACKGROUND OF THE INVENTION

A. Field of the Invention

The present invention relates to business forms and more particularly to a business form which is capable of being read from or written on electronically. The present invention also relates to a business form which is essentially fraud proof even in view of the modern color copier and computer. The present invention also relates to a business form in which one part forms the input for a computer and functions as a memory device.

B. Prior Art

A detailed discussion of the prior art relating to checks is contained in the Patentability Statement submitted with U.S. Patent Application entitled "Check", Ser. No. 879,114, invented by the inventors of the present invention. To the extent that a check is a business form that discussion is applicable in the present case. The term "Business Form" encompases a much broader field than checks. The term clearly encompasses invoices, shipping and receiving documents, ledger cards, tickets, tags, statements, negotiable instruments, stocks and bond certificates of all types, order forms, inventory forms, agreement (contract) forms, deeds, bills of material, test answer forms, and many others.

Electrosensitive paper is known as an output paper for printers. One such electro-sensitive paper is a roll of a light weight base (about 25 pound offset stock) with a thin aluminum coating. The paper frequently has a layer of ink beneath the aluminum coating. The paper has been used as a tape to give the user an "audit-trail".

Until the invention by Vurpillat and Margolin in the co-pending application entitled "Computer Input-Output Device" it was not recognized that it was possible to read from and write on the same electro-sensitive paper. A host of alteration and fraud problems including those created by color copiers and computers are now easily remedied.

SUMMARY OF THE INVENTION

The present invention discloses a novel business form or document having at least two coatings or layers. One of the layers functions as a base layer. The two layers are of contrasting color and of significantly different electrical conductivity. One embodiment of the present invention has a base material with two layers placed thereon. The layers are of contrasting color and electrical conductivity. The document is normally opaque to visible light. A third layer of ink or other coloring material is overlaid on the first and second layers in a matrix (array) to organize the document into specific areas or segments. The third layer has a color which normally contrasts with both of the first and second layers. The color of the third layer contrasts with the color of the second layer so that the array is visible to the human eye. The same printing step which applies the matrix layer can also apply a light overlay of another color. The light overlay may be printed in a further step.

The second or upper coating is of a type which can be vaporized electrically by exposure for a short time (generally about 0.0004 of a second) to a voltage of about 40 to 100 volts. After the second layer has been vaporized the document may be read optically, resistively, conductively or capacitively. These are substantially the same things. When read electronically a segment of the business form may operate as the memory for a computer. The memory segment may appear in several places on the form. A particular memory segment can be readily detachable from the remainder of the business form.

The second layer is of such a nature that any attempt to remove it by an unauthorized party further exposes the under coating of contrasting color, thereby showing the attempt at alteration.

The second layer also has a smooth glossy surface which is essentially totally repellant to any fluid of relatively high surface tension such as water based inks and xerographic toners during the fusing stage. These properties of the second layer result in a business form paper which cannot be copied onto by a xerographic or electrostatic copier and on a shiny surface appearance which cannot be reproduced by any known xerographic or electrostatic color or black and white copier.

One of the special properties of the inventive business form is that it may be written on and read from by a bi-laterial (two way) electrosensitive input-output device disclosed in the above mentioned co-pending application.

In the most common embodiment of the present invention the base material is formed from a paper having a weight of about 24 pounds (or about 60 pounds offset). The first layer is formed of an ink or other coloring material of any contrasting color such as black, red, blue or the like. In any embodiment of the present invention the first layer may itself be a multi-colored layer. The second layer is formed of aluminum or other similar electrical conductor. The third layer (organizing layer) of ink or other coloring is overlaid on the upper or second coating in a matrix (array) to organize the document into specific segments. The third layer is of a color which contrasts with the color of the second layer so that the organization of the document is recognizable by a person. A fourth color of ink of any color is optionally overlaid on the aluminum layer to reduce glare and inprove readability without altering the liquid ink repelling properties of the second layer. The order of adding the "array" layer (third layer) and the fourth color (glare reducing layer) is immaterial. In practice the array layer and the fourth color may be printed at the same time. The glare reducing layer is preferably of inks which have infra-red or ultra-violet absorbing properties for drying in infra-red or ultra-violet heated ovens.

DESCRIPTION OF THE INVENTION

Figure 1:
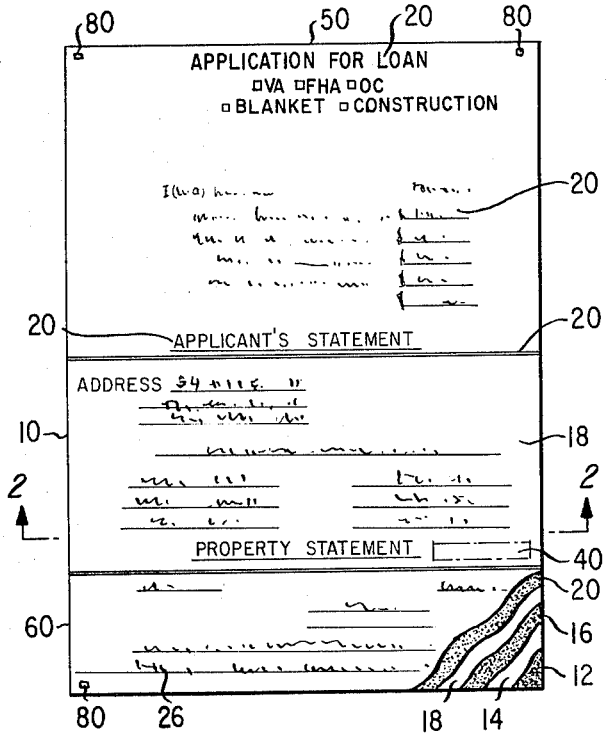
FIG. 1 shows a plan view of one embodiment of the present invention.
Figure 2:
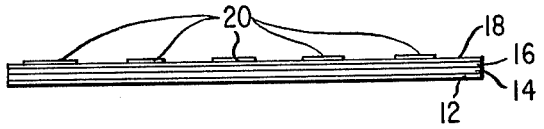
FIG. 2 shows a sectional view of the embodiment shown in FIG. 1 taken along the line 2—2 show in FIG. 1.
Figure 3:
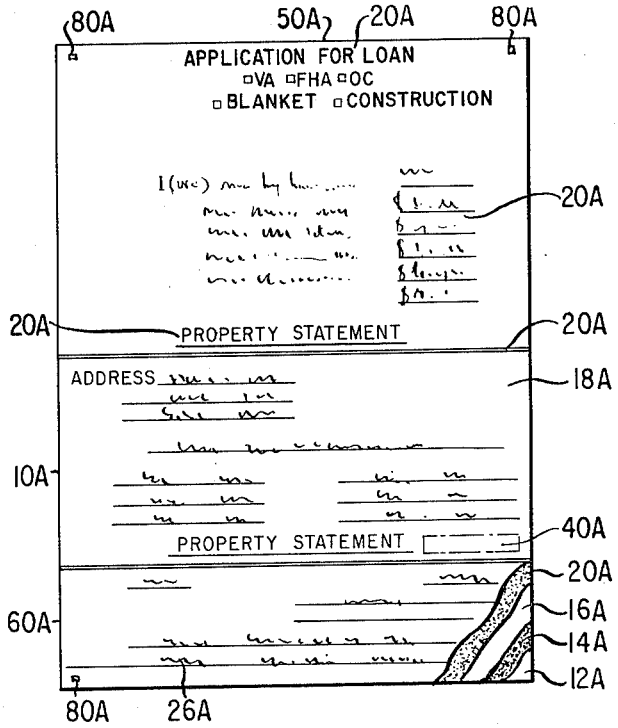
FIG. 3 shows a plan view of a second embodiment of the present invention.

FIGS. 1 and 3 depict business form or document 10, 10A shown as an "Application for Loan". Any business form from an admission ticket to a zoning application can be used. A base layer 12, 12A is formed from paper plastic or other suitable material. The base layer must have sufficient stiffness to pass through or be passed over non-distructively by an electro-sensitive reader, writer or combination reader-writer. One such base layer is formed from a bond paper in the 20 to 30 pound range (i.e., 50 to 70 pound offset paper). A first layer or coat of ink 14, 14A is applied to the base 12, 12A. The first layer 14, 14A is normally of a readily visible color. The first layer 14, 14A is normally electrically non-conductive. The second layer 16, 16A is opaque to visible light. The second layer 16, 16A, normally electrically conductive, is a metal or doped non metal. Aluminum is frequently chosen as the material for the second layer 16, 16A. The color of the second layer 16, 16A should contrast with that of the first layer 14, 14A. When a portion of the second layer 16, 16A is removed the electrical properties (resistance or capacitance) of the structure is altered locally.

Although the normal order of first and second layers 14, 14A and 16, 16A is ink (non-conductor) and aluminum (conductor). The order may be reversed making the first layer 14, 14A conductive and the second layer 16, 16A non-conductive. The second layer 16, 16A is vaporizable by a relatively short exposure to an electric signal of about 40 to 100 volts and for a time of about 0.0004 seconds. The second layer 16, 16A normally has such a smooth hard finish so that it will not absorb water or other liquid base inks where the liquids have relatively high surface tensions and require a unwetted surface to adhere. Therefore water based inks, xerographic and similar toners in the liquid state will not adhere to the second layer 16, 16A. Although the present invention has thusfar been described as a three layer structure it may also be a two layer structure. In that embodiment the first and second layers are of different color and conductivity and the first layer functions as the base layer. The first layer may be a plastic, paper or other suitable material.

A fourth color 18, 18A may be put down on top of all or a portion of the second layer 16. FIG. 1 shows the fourth color 18 or all of the documents 10, while FIG. 3 shows fourth color 18A only on a portion of the document 10A. The fourth color 18, 18A is standard offset ink or an offset ink having ultra-violet or infra-red absorbing properties. Such an ink may be rapidly dried in an oven using infra-red or ultra-violet energy. The fourth color 18, 18A reduces the glare from the second layer 16, 16A and makes it easier to read. The fourth color 18, 18A may be omitted in one embodiment of the present invention.

A third layer or (organizing layer) 20, 20A of ink or other coloring material is overlaid the second layer 16, 16A or the fourth color 18, 18A as the case may be to organize the document into specific areas or segments. This coating may be in writing, printing, code or merely lines, curves or the like so that the organization will be readily discernable by the human eye. The order of adding the array (organizing) layer 20, 20A and the glare reducing layer 18, 18A is not material. In practice the array layer and the glare reducing color are often added in the same printing step. The document 10, 10A may be organized into a plurality of segments as shown in FIGS. 1 and 3. However segments 50, 50A may be detachable from segments 60, 60A respectively. These segments 50 and 60 and 50A and 60A may have identical information on them, except that one, 50, 50A is shown as optically readable while the other 60, 60A is shown having bar code or binary code 26, 26A formed thereon. Of course, optically readable information may be displayed on the "stub" or "trailer" 60, 60A. The stub 60, 60A can function as the memory for a computer system. Similarly a portion of the segment 50, 50A may also function as a memory segment for a computer system. The business form may have one or more memory segments some of which can be readily detachable. Registration marks 80, 80A are shown in segments 60, 50A, 60 and 60A so that a reader, printer or reader-printer (not shown in this application but shown and described in one of applications incorporated by reference into this application) may either read or write with the document. The registration marks have horizontal, vertical and timing information.

An ink absorptive strip 40, 40A may be applied to a portion of the document 10, 10A to enable signature by a person using a water based ink. Ball point pen ink will be accepted by any portion of the document surface.

Other embodiments of the present invention will occur to those skilled in the art. Such embodiments are clearly within the scope of the present invention as described in the appended claims.

In summary, the present invention shows a novel business form or document which may be used in connection with an electro-sensitive reader, printer or reader-printer which is essentially fraud proof, unique appearing, has the ability to be machine read and optically (humanly) read, and to have a segment function as a computer memory.

We claim:

1. A business document comprising in combination:
a first layer;
a second layer overlying said first layer, said first and second layers having substantially different electrical conductivity and color; at least one of said layers is opaque to light;
one of said layers being electrically vaporizable upon exposure to an electrical discharge; and
a third layer put down over a portion of said second layer organizing said second layer into segments.

2. The article claimed in claim 2 wherein:
a fourth layer overlays at least a portion of said second layer wherein said fourth layer has a color different from said second and third layers.

3. The article claimed in claim 1 wherein:
one of said first and second layers contains a coloring material and the other of said layers is formed of an electrically conductive substance.

4. The article claimed in claim 1 wherein:
said second layer is substantially impervious to fluids which wet surfaces.

5. The article claimed in claim 1 wherein:
one of said first or second layers is electrically vaporizable by a voltage of about 50 volts lasting for about 0.0004 of a second.

6. The article claimed in claim 1 wherein:
the absence of a portion of said second layer changes the electrical characteristics of the article in the region of the absent portion.

7. The article claimed in claim 1 wherein:

a reader writer is adapted to electrically read and write onto said article by removing a portion of said second layer and by sensing the absence of said layer.

8. The article claimed in claim 1 wherein:

said first layer comprises a plurality of colors.

9. The article claimed in claim 1 including further:

a base layer underlying said first and second layers.

10. The article claimed in claim 9 wherein:

said base layer is a paper substance;

said first layer is an ink substance; and, said second layer is an aluminum material.

11. The article claimed in claim 9 wherein:

said base layer is a plastic.

12. The article claimed in claim 10 wherein:

a fourth layer of ink of contrasting color overlays said second layer; said fourth layer having properties and a thickness such that the shiny surface of the aluminum layer and the first layer is visible through said fourth layer of ink and the fluid absorbing properties of said second layer are not altered.

13. The article claimed in claim 10 wherein:

said document is divided into at least two severable segments in which at least one of said segments has a memory part for providing the memory input to a computer.

14. The article claimed in claim 13 wherein:

said memory part has at least one portion of said second layer removed in a manner corresponding to a machine readable code.

15. The article claimed in claim 14 wherein said memory part is created in at least two of said severable segments.

16. The article claimed in claim 13 wherein:

at least one of said severable segments has at least one mark thereon for enabling the position of said memory part to be sensed by a computer terminal device.

17. The article claimed in claim 13 wherein:

at least one of said severable segments has a plurality of timing marks formed thereon.

18. A business form comprising at least first and second layers in which said first layer is electrically non-conductive and said second layer is electrically conductive;

said layers being of contrasting colors;

said second layer being electrically vaporizable upon exposure to an electrical discharge;

the surface of said form being organized into a plurality of segments by a third layer.

19. The article claimed in claim 18 wherein:

said form is further organized into at least first and second separable parts in which said first part has a memory part containing a machine readable representation of the information contained in the second part of the form.

20. The article claimed in claim 18 wherein:

a fourth layer overlying said second layer having properties and thickness to leave unaltered the appearance and liquid absorption properties of said second layer;

said fourth color contrasting to the color of said first and second layers.

21. The article claimed in claim 18 wherein:

said first and second layers are deposited on a paper base and said second layer is formed of a thin coating of metal having a surface not absorptive to liquids which wet surfaces.

22. The article claimed in claim 21 wherein:

said first layer is formed of ink and said second layer is aluminum.

23. The article claimed in claim 22 wherein:

a layer of liquid absorbing material is adhered to said second layer to enable it to accept inks which wet the surface they touch.

24. The article claimed in claim 19 wherein:

a plurality of marks on said memory part enables a computer terminal device to sense the position of said memory part.

25. The article claimed in claim 19 wherein:

a plurality of marks on the second part of said article enables a computer terminal device to sense the position of said second part.

26. The article claimed in claim 19 wherein:

a plurality of timing marks are formed on said memory part to enable a computer terminal device to read said memory part.

27. The article claimed in claim 19 wherein:

a plurality of timing marks are formed on said second part to enable a computer terminal device to read said memory part.

28. The article claimed in claim 19 wherein:

both said first and second parts have memory parts containing machine readable information.

29. The article claimed in claim 28 wherein:

said first and second parts have horizontal, vertical and timing synchronization marks formed thereon.

30. The article claimed in claim 1 wherein:

said first layer is formed of a plastic.

31. The article claimed in claim 1 wherein:

said first layer is formed of paper.

* * * * *